US010103485B2

(12) United States Patent
Ikeda et al.

(10) Patent No.: US 10,103,485 B2
(45) Date of Patent: Oct. 16, 2018

(54) COAXIAL CONNECTOR

(71) Applicant: Hirose Electric Co., Ltd., Tokyo (JP)

(72) Inventors: Kazuhiko Ikeda, Tokyo (JP); Koyo Shimizu, Tokyo (JP); Takumi Yoshida, Tokyo (JP)

(73) Assignee: HIROSE ELECTRIC CO., LTD., Tokyo (JP)

( * ) Notice: Subject to any disclaimer, the term of this patent is extended or adjusted under 35 U.S.C. 154(b) by 0 days.

(21) Appl. No.: 15/659,579

(22) Filed: Jul. 25, 2017

(65) Prior Publication Data

US 2018/0034205 A1 Feb. 1, 2018

(30) Foreign Application Priority Data

Jul. 27, 2016 (JP) ..... 2016-147210

(51) Int. Cl.

| | |
|---|---|
| ***H01R 13/631*** | (2006.01) |
| ***H01R 24/50*** | (2011.01) |
| ***H01R 33/20*** | (2006.01) |
| ***H01R 4/60*** | (2006.01) |
| *H01R 103/00* | (2006.01) |
| *H01R 13/405* | (2006.01) |
| *H01R 4/02* | (2006.01) |

(52) U.S. Cl.

CPC ..... *H01R 13/631* (2013.01); *H01R 4/60* (2013.01); *H01R 24/50* (2013.01); *H01R 33/20* (2013.01); *H01R 4/027* (2013.01); *H01R 13/405* (2013.01); *H01R 2103/00* (2013.01)

(58) Field of Classification Search

CPC ..... H01R 13/631; H01R 24/50; H01R 33/20

USPC ..... 439/620.03

See application file for complete search history.

(56) References Cited

U.S. PATENT DOCUMENTS

| | | | | |
|---|---|---|---|---|
| 5,980,290 | A * | 11/1999 | Meynier | H01R 13/6315 439/246 |
| 6,497,579 | B1 * | 12/2002 | Garbini | H01R 13/6315 439/246 |
| 9,160,121 | B2 * | 10/2015 | Wagner | H01R 13/6315 |
| 2008/0057782 | A1 * | 3/2008 | Berthet | H01R 13/6315 439/581 |

(Continued)

FOREIGN PATENT DOCUMENTS

JP 2003178844 6/2003

*Primary Examiner* — Alexander Gilman

(74) *Attorney, Agent, or Firm* — Procopio, Cory, Hargreaves & Savitch LLP

(57) ABSTRACT

Coaxial connector including a center conductor provided inside an outer conductor with a tubular outer conductor main body. A mating portion on one side in the axial direction of the outer conductor main body detachably mates with a counterpart connector. A supporting portion on the other side in the axial direction of the outer conductor main body supports the center conductor through the insulating member medium. Securing portions projecting from the end face on the other side in the axial direction or from the outer peripheral surface on the other side in the axial direction of the outer conductor main body towards the other side in the axial direction securing the outer conductor by soldering to a conductor pattern on the board surface. A first barrier portion on the outer peripheral surface on the other side in the axial direction of the outer conductor main body blocks solder flow.

15 Claims, 5 Drawing Sheets

(56) References Cited

U.S. PATENT DOCUMENTS

2015/0072556 A1* 3/2015 Hirakawa ..... H01R 24/50
439/578
2018/0034205 A1* 2/2018 Ikeda ..... H01R 13/631

* cited by examiner

COAXIAL CONNECTOR

CROSS REFERENCE TO RELATED APPLICATIONS

This Paris Convention Patent Application claims benefit under 35 U.S.C. § 119 and claims priority to Japanese Patent Application No. JP 2016-147210, filed on Jul. 27, 2016, titled "COAXIAL CONNECTOR", the content of which is incorporated herein in its entirety by reference for all purposes.

BACKGROUND

Technical Field

The present invention relates to a board-mounted coaxial connector.

Background Art

Board-mounted type coaxial connectors may be used, for example, in electronic appliances as means for electrically connecting circuits formed on a board and components independent of the board. An example of such a coaxial connector is described in Patent Document 1 below.

As shown in FIG. 1 of Patent Document 1, the coaxial connector of the same document is provided with a tubular outer conductor and a center conductor pin provided inside the outer conductor. Said coaxial connector is surface-mounted to the board and, at such time, the outer conductor is securely connected to a circuit pattern formed on the surface of the board by soldering.

PRIOR ART DOCUMENT

Patent Documents

Patent Document 1: Japanese Patent Application No. 2003-178844

SUMMARY

Problems to be Solved by the Invention

A coaxial connector mounted (especially surface-mounted) to a board is secured to the board mainly by soldering a tubular outer conductor located on the outer periphery of the coaxial connector to a conductor pattern formed on the board. In order to ensure superior bond strength between the coaxial connector and the board, it is desirable for an appropriate amount of solder to be present after bonding in the junction section between the outer conductor and the conductor pattern. Specifically, it is desirable that an appropriate amount of solder be interposed between the surface of the conductor pattern and the end face of the outer conductor facing it, and, at the same time, it is desirable for fillets of appropriate size to be formed from the surface of the conductor pattern over a section on the outer peripheral surface of the outer conductor proximate the end face of the outer conductor. When the junction section is heated in order to bond the outer conductor to the conductor pattern with solder, the solder applied to the surface of the conductor pattern melts and expands on the surface of the outer conductor, thereby forming the fillets.

Incidentally, sometimes the board is re-heated after bonding the outer conductor of the coaxial connector to the conductor pattern on the board with solder. This is done, for instance, when mounting components to both sides of the board or when correcting soldering defects in already mounted components. If the board is re-heated after bonding the outer conductor to the conductor pattern with solder, the solder present in the junction portion between the outer conductor and the conductor pattern melts again and said solder may excessively expand on the surface of the outer conductor. As a result, the amount of solder present in said junction section may be reduced and the strength of the bond between the coaxial connector and the board may decrease.

The present invention was made by taking the above-described problems into consideration and it is an object of the invention to provide a coaxial connector in which the strength of the bond to the board can be maintained even if the board is re-heated after bonding the outer conductor to the conductor pattern on the board with solder.

Means for Solving the Problems

Systems and methods described herein are configured to maintain the strength of the bond between the coaxial connector and the board even if the board is re-heated after the outer conductor of the coaxial connector is bonded to the conductor pattern on the board with solder.

In order to eliminate the foregoing problem, in the inventive coaxial connector, which is a coaxial connector provided with an outer conductor and a center conductor provided inside the outer conductor, the outer conductor is provided with: a tubular outer conductor main body; a mating portion, which is formed on one side in the axial direction of the outer conductor main body and detachably mates with a counterpart connector; a supporting portion, which is formed on the other side in the axial direction of the outer conductor main body and supports the center conductor through the medium of an insulating member; securing portions, which project from the end face on the other side in the axial direction or from the outer peripheral surface on the other side in the axial direction of the outer conductor main body towards the other side in the axial direction and secure the outer conductor by soldering to a conductor pattern formed on the surface of the board; and a first barrier portion, which is formed on the outer peripheral surface on the other side in the axial direction of the outer conductor main body, or on a section located away from the edge on the other side in the axial direction of the securing portions toward one side in the axial direction on the outer peripheral surface of the securing portions, and which blocks the flow of solder.

According to this aspect of the present invention, even if the board is re-heated after bonding the outer conductor to the conductor pattern on the board, the first barrier portion makes it possible to prevent excessive expansion of the solder that secures the outer conductor to the conductor pattern of the board on the outer peripheral surface of the outer conductor main body or to a section located away from the edge on the other side in the axial direction of the securing portions toward one side in the axial direction on the outer peripheral surface of the securing portions. This makes it possible to minimize any reduction in the amount of solder present in the junction section between the outer conductor and the conductor pattern and makes it possible to prevent a reduction in the strength of the bond between the coaxial connector and the board.

In addition, in the above-described inventive coaxial connector, an expanded portion expanded in the radial direction to a greater extent than the outer peripheral surface on the other side in the axial direction of said outer conductor main body is preferably formed on the other side in the axial direction of the outer conductor main body, and the first barrier portion is preferably formed on the outer peripheral surface of the expanded portion.

In addition, in the above-described inventive coaxial connector, a second barrier portion may be formed on the end face on the other side in the axial direction of the outer conductor main body. In addition, a third barrier portion may be formed on the inner peripheral surface on the other side in the axial direction of the outer conductor main body, and, furthermore, a fourth barrier portion may be formed on the inner peripheral surface of the securing portions.

In addition, in the above-described inventive coaxial connector, the first barrier portion may be formed on the outer peripheral surface on the other side in the axial direction of the outer conductor main body at a position located away from the edge on the other side in the axial direction toward one side in the axial direction.

In addition, in the above-described inventive coaxial connector, two securing portions may be formed on the end face on the other side in the axial direction of the outer conductor main body or on the outer peripheral surface on the other side in the axial direction, and the two securing portions may be disposed in a mutually spaced relationship in the radial direction of the outer conductor main body. In addition, in the above-described inventive coaxial connector, four securing portions may be formed at intervals in the circumferential direction on the end face on the other side in the axial direction of the outer conductor main body or on the outer peripheral surface on the other side in the axial direction. In addition, in the above-described inventive coaxial connector, the securing portions may be formed in a C-shaped, U-shaped, or □-shaped configuration when the outer conductor is viewed from the other side in the axial direction.

Effects of the Invention

According to the present invention, the strength of the bond between the coaxial connector and the board can be maintained even if the board is re-heated after the outer conductor of the coaxial connector is bonded to the conductor pattern on the board with solder.

DETAILED DESCRIPTION (Embodiment 1)

Figure 2:
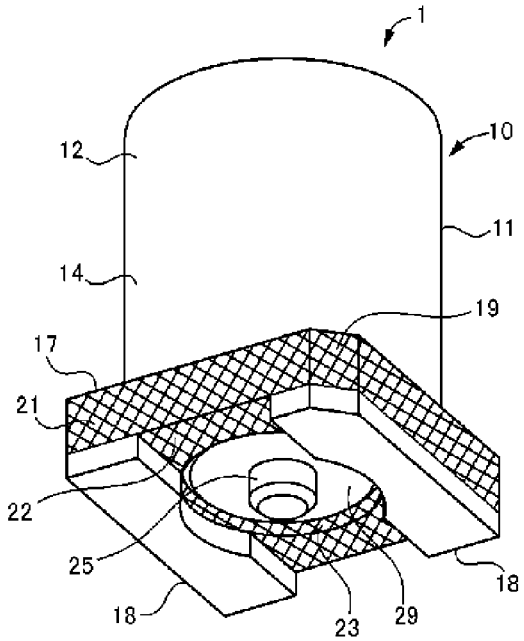
FIG. 2 illustrates an explanatory drawing illustrating the coaxial connector of Embodiment 1 of the present invention viewed obliquely from below.
Figure 3:
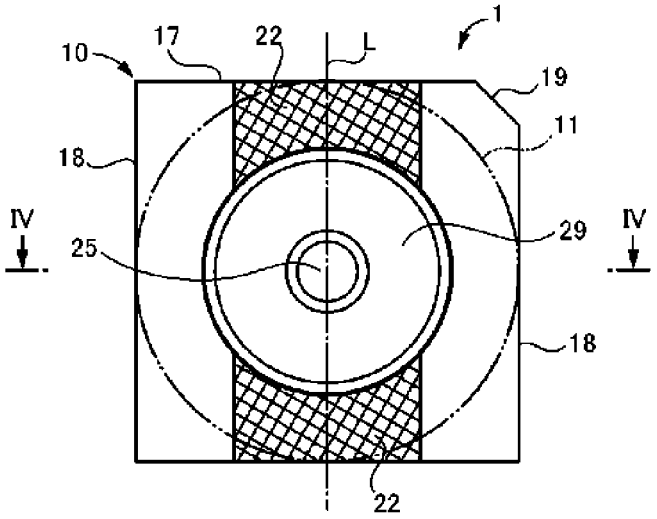
FIG. 3 illustrates an explanatory drawing illustrating a coaxial connector of Embodiment 1 of the present invention viewed from below.
Figure 4:
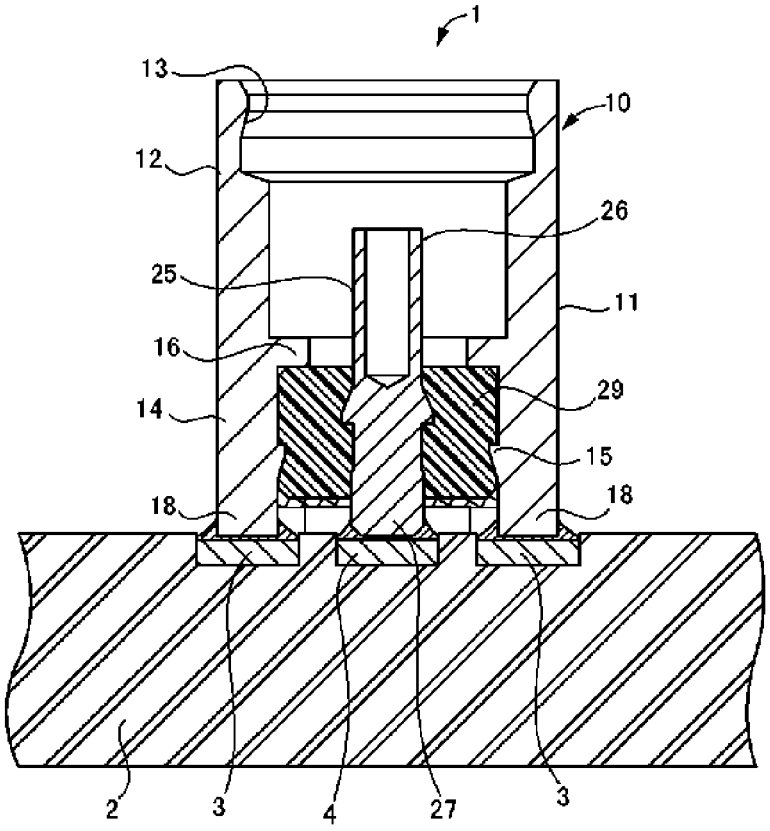
FIG. 4 illustrates a vertical cross-sectional view illustrating the coaxial connector of Embodiment 1 of the present invention along with a board.
Figure 5:
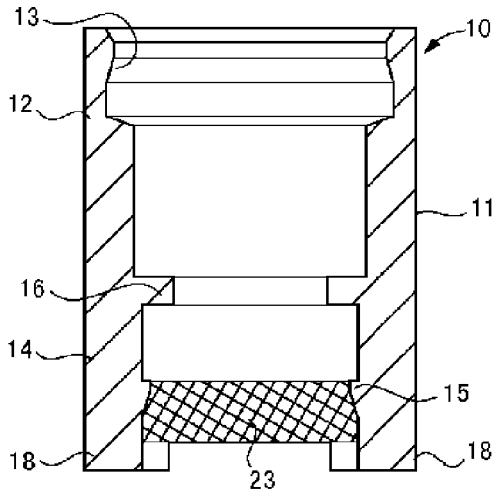
FIG. 5 illustrates a vertical cross-sectional view illustrating the outer conductor of the coaxial connector of Embodiment 1 of the present invention.

FIGS. 1 through 4 illustrate a coaxial connector 1 of Embodiment 1 of the present invention. Specifically, FIG. 1, FIG. 2, and FIG. 3 respectively illustrate the coaxial connector 1 as viewed obliquely from above, as viewed obliquely from below, and as viewed from below. FIG. 4 shows a cross-section of the coaxial connector 1 and board 2 viewed in the direction of arrows IV-IV in FIG. 3. In addition, FIG. 5 illustrates only the outer conductor 10 of the coaxial connector 1 depicted in FIG. 4. It should be noted that, for ease of explanation, the discussion below uses examples in which the board 2 is placed horizontally and the coaxial connector 1 is mounted to the upper surface of the board 2.

As shown in FIGS. 1 to 4, the coaxial connector 1 is a surface mount-type coaxial connector mounted to a surface of a board 2 such that its axial line is perpendicular to the surface of the board 2 (see FIG. 4). Inserting a counterpart connector in the coaxial connector 1 from above the board 2 can establish an electrical connection between the counterpart connector and the circuits formed on the board 2. The coaxial connector 1 is provided with an outer conductor 10, a center conductor 25, and an insulating member 29.

Figure 1:
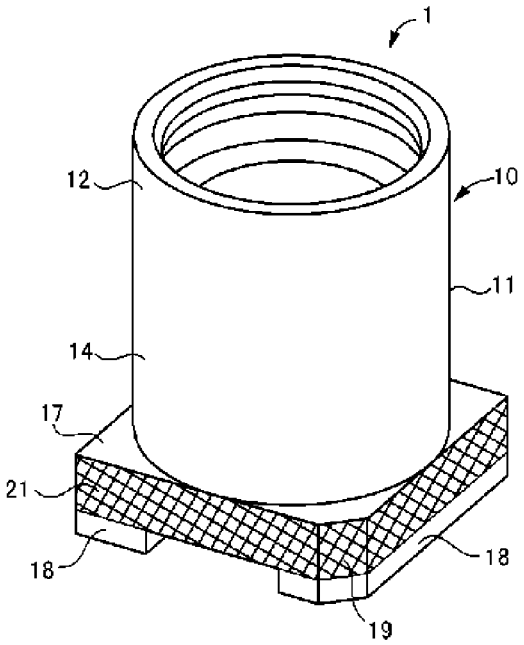
FIG. 1 illustrates an explanatory drawing illustrating the coaxial connector of Embodiment 1 of the present invention viewed obliquely from above.

As shown in FIG. 1, the outer conductor 10 is formed in the shape of a cylinder. In addition, the outer conductor 10 is formed by machining metallic materials, for example, brass or phosphor bronze, and then subjecting said machined metallic materials to nickel and gold-plating. While there are no limitations regarding the size of the outer conductor 10, it can have, for instance, a diameter of 5-6 mm and a height of 7-8 mm. The outer conductor 10 serves as an outer shell for the coaxial connector 1, as an electrical connection means, such for grounding, etc., and as a means for securing the coaxial connector 1 to the board 2.

The outer conductor 10 has a cylindrical outer conductor main body 11. A mating portion 12, which detachably mates with a counterpart connector, is formed on one side in the axial direction of the outer conductor main body 11, namely, in the present embodiment, in the upper part of the outer conductor main body 11. A counterpart connector can be inserted into the mating portion 12 from above. As shown in FIG. 4, a connector engagement portion 13 is formed on the inner peripheral surface of the mating portion 12. The connector engagement portion 13 is formed as a recessed portion or bulging portion formed around a section of the inner peripheral surface of the mating portion 12. The counterpart connector inserted into the mating portion 12 is engaged by the connector engagement portion 13.

A supporting portion 14, which supports the center conductor 25 through the medium of an insulating member 29, is formed on the other side in the axial direction of the outer conductor main body 11, namely, in the present embodiment, in the bottom part of the outer conductor main body 11. An insulating member engagement portion 15, which secures the insulating member 29, is formed in the supporting portion 14.

An interfacing portion 16 is formed on the inner peripheral surface of the outer conductor main body 11 located between the mating portion 12 and the supporting portion 14. The interfacing portion 16 is formed as a bulging portion formed around a section of the inner peripheral surface of the outer conductor main body 11. It should be noted that a space is retained in the center of the interfacing portion 16 to allow the center conductor 25 to pass through a gap. The outer conductor of the counterpart connector inserted in the mating portion 12 comes in contact with the inner peripheral surface of the mating portion 12 and the upper surface of the interfacing portion 16.

As shown in FIG. 1, an expanded portion 17, which is expanded in the radial direction to a greater extent than the outer peripheral surface of said section, is formed in the bottom part of the outer conductor main body 11. In the present embodiment, the expanded portion 17 is disposed in the lower end portion of the outer conductor main body 11. The external configuration of the expanded portion 17 is that of a rectangular parallelepiped. Four planar surfaces facing, respectively, forward, backward, left, and right are formed in the outer peripheral portion of the expanded portion 17. In addition, as shown in FIG. 3, when the coaxial connector 1 is viewed from below, the external configuration of the expanded portion 17 is substantially square, with the length dimensions of one side of this square being equal to the outside diameter dimensions of the outer conductor main body 11. For this reason, when the coaxial connector 1 is viewed from below, the only sections within the expanded portion 17 that expand in the radial direction to a greater extent than the outer peripheral surface in the bottom part of the outer conductor main body 11 are the four angular portions of the expanded portion 17.

As shown in FIG. 2, securing portions 18, which secure the outer conductor 10 by soldering to the conductor pattern 3 formed on the surface of the board 2, are formed on the lower end side of the outer conductor main body 11. It should be noted that the conductor pattern 3 includes wiring patterns, pads, and the like. The securing portion 18 project downwardly from the lower end face of the outer conductor main body 11 or from the outer peripheral surface at the bottom part. In the coaxial connector 1 of the present embodiment, the expanded portion 17 is disposed in the bottom part of the outer conductor main body 11, and the securing portions 18 project downwardly from the outer peripheral portion on the lower end face of the expanded portion 17. It should be noted that the outer peripheral portion on the lower end face of the expanded portion 17 corresponds to the lower end face or the outer peripheral surface at the bottom part of the outer conductor main body 11. In this manner, another function of the securing portions 18, which project downwardly from the outer conductor main body 11, is to separate the lower end face of the outer conductor main body 11 from the board 2.

There are two securing portions 18 formed, and these securing portions 18 are disposed in a mutually spaced relationship in the radial direction of the outer conductor main body 11. In addition, as shown in FIG. 3, the position and general shape of these securing portions 18 are configured such that they are linearly symmetric with respect to a straight line L that intersects the axial line of the outer conductor main body 11 and extends in the radial direction. In addition, as shown in FIG. 4, the lower end faces of the securing portions 18 are faces placed in contact with the solder applied to the surface of the conductor pattern 3 of the board 2. In addition, the peripheral faces of the securing portions 18 are faces that are contacted by fillets 5 formed by the solder applied to the surface of the conductor pattern 3 (see FIG. 6).

Forming the expanded portion 17 on the outer conductor main body 11 and forming the securing portions 18 on the outer peripheral portion on the lower end face of the expanded portion 17 in this manner allows for the range of support of the coaxial connector 1 on the board 2 to be increased and makes it possible to stabilize the orientation of the coaxial connector 1 on the board 2. On the other hand, making the shape of the expanded portion 17 square when the coaxial connector 1 is viewed from below and making the length dimensions of one side of this square equal to the diameter dimensions of the outer conductor main body 11 makes it possible to reduce the surface area occupied by the coaxial connector 1 on the board 2. In addition, disposing two securing portions 18 in a mutually spaced relationship in the radial direction of the outer conductor main body 11 makes it possible to place other conductor patterns formed on the board 2 (for example wiring sections) between the two securing portions 18. This can increase the degree of freedom in terms of placement of the conductor pattern 3 or components mounted to the board 2. Alternatively, this can increase the density of component mounting to the board 2. In addition, separating the two securing portions 18 from each other makes it possible to readily verify the quality of soldering through the gap between the securing portions 18. In addition, as shown in FIG. 3, when the coaxial connector 1 is viewed from below, it can be seen that a chamfered portion 19 is formed in one angular portion of the square expanded portion 17 as well as in a section of the securing portion 18 corresponding to said angular portion of the expanded portion 17. Forming the chamfered portion 19 makes it possible to readily determine the circumferential orientation of the coaxial connector 1 on the board 2 when the coaxial connector 1 is mounted.

On the other hand, as shown in FIG. 1, in the coaxial connector 1, a first barrier portion 21, which blocks the flow of solder, is formed on the outer peripheral surface in the bottom part of the outer conductor main body 11. Specifically, in the coaxial connector 1 of the present embodiment, the expanded portion 17 is formed in the bottom part of the outer conductor main body 11 and the first barrier portion 21 is formed on the outer peripheral surface of the expanded portion 17. The first barrier portion 21 is formed along the entire perimeter of the expanded portion 17. In other words, it is formed on the respective forward-, backward-, left-, and right-facing faces in the expanded portion 17, as well as on the face where the chamfered portion 19 is formed. In addition, the first barrier portion 21 is formed on these faces of the expanded portion 17 across the entire surface from the edge of the lower end to the edge of the upper end. In addition, as shown in FIG. 2 or FIG. 3, a second barrier portion 22, which blocks the flow of solder, is formed across the entire surface of the section of the lower end face of the outer conductor main body 11 where the securing portions 18 are not formed. Furthermore, as shown in FIG. 5, a third barrier portion 23, which blocks the flow of solder, is formed along the entire perimeter on the inner peripheral surface in the bottom part of the outer conductor main body 11. It should be noted that, in the coaxial connector 1 depicted in FIGS. 1 to 5, a grid pattern is applied to the sections in which the first barrier portion 21, second barrier portion 22, or third barrier portion 23 are formed (also in FIG. 6, FIG. 9, FIG. 10, and FIG. 11).

In comparison with the surface of other sections of the outer conductor 10, the first barrier portion 21, second barrier portion 22, and third barrier portion 23 have relatively low solder wettability. Specifically, in this embodiment, nickel plating is exposed in the first barrier portion 21, second barrier portion 22, and third barrier portion 23, while gold plating is exposed on the surface of other sections of the outer conductor 10. In other words, a nickel barrier is formed in the first barrier portion 21, second barrier portion 22, and third barrier portion 23. In comparison with the surface of other sections of the outer conductor 10, solder has difficulty adhering to the first barrier portion 21, second barrier portion 22, and third barrier portion 23.

It should be noted that, in addition to, or instead of, the outer peripheral surface (outer peripheral surface of the expanded portion 17) at the bottom part of the outer conductor main body 11, the first barrier portion 21 may be formed on the outer peripheral surface of the securing portions 18 at a position located upwardly away from the lower side edge of the securing portions 18. Namely, while it is necessary to avoid forming barrier portions in the section of the outer peripheral surface of the securing portions 18 located closer to the lower end face of the securing portions 18 in order to ensure contact with solder (fillets), a barrier portion may be formed in a section located above that section.

On the other hand, as shown in FIG. 4, a center conductor 25 is provided inside the outer conductor 10. The center conductor 25 has a rod-like external configuration and is formed by subjecting metallic materials, for example, brass or phosphor bronze, to nickel-plating and gold-plating. A contact portion 26, which comes in contact with the center conductor of a counterpart connector, is formed in the upper end portion of the center conductor 25. In addition, a connecting portion 27, which is connected to a conductor pattern 4 formed on the board 2, is formed in the lower end portion of the center conductor 25. A barrier portion blocking the flow of solder, such as a nickel barrier or the like, may be formed in the center conductor 25 between the contact portion 26 and the connecting portion 27. It should be noted that, in electrical terms, for example, the conductor pattern 3 to which the securing portions 18 of the outer conductor 10 are bonded is part of the ground path of the circuitry formed on the board 2, and the conductor pattern 4 to which the center conductor 25 is connected is part of the signal path of the circuitry formed on the board 2. In addition, the insulating member 29 is formed from an insulating material, such as resin or the like. The insulating member 29 is secured to the supporting portion 14 of the outer conductor 10, and the center conductor 25 is secured to the insulating member 29.

If the coaxial connector 1 of the present embodiment is used, the first barrier portion 21, second barrier portion 22, and third barrier portion 23 can be used to prevent the solder that bonds the securing portions 18 of the outer conductor 10 and the conductor pattern 3 of the board 2 from excessively expanding even if the board 2 is re-heated after bonding the outer conductor 10 to the conductor pattern 3 of the board 2. Specifically, the first barrier portion 21 can be used to prevent the solder that bonds the securing portions 18 and the conductor pattern 3 from expanding across the outer peripheral surface of the outer conductor main body 11 and flowing upwards. In addition, the second barrier portion 22 can be used to prevent the solder that bonds the securing portions 18 and the conductor pattern 3 from expanding to the lower end face of the outer conductor main body 11. Furthermore, the third barrier portion 23 can be used to prevent the solder that bonds the securing portions 18 and the conductor pattern 3 from expanding across the inner peripheral surface of the outer conductor main body 11 and flowing upwards. Consequently, it is possible to minimize any reduction in the amount of the solder bonding the securing portions 18 and the conductor pattern 3 due to the re-heating of the board 2, and accordingly, to minimize any decrease in the strength of the bond between the coaxial connector 1 and board 2. Accordingly, it is possible to prevent the coaxial connector 1 from being detached from the conductor pattern 3 of the board 2 when a counterpart connector is pulled out of the coaxial connector 1, and to prevent poor electrical connections between the outer conductor 10 and the conductor pattern 3.

Figure 6:
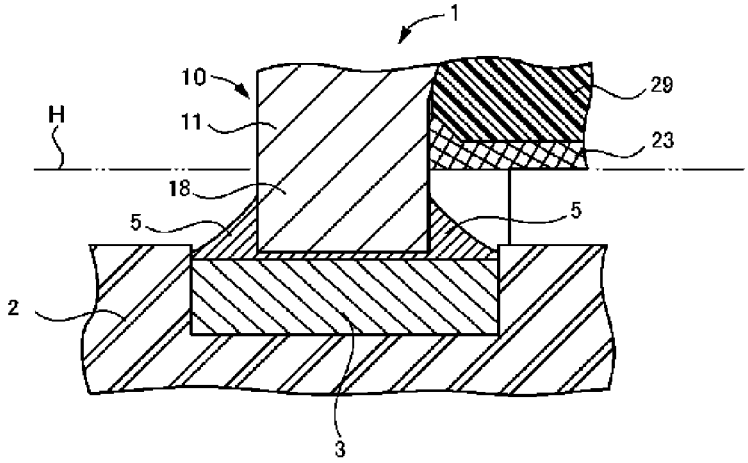
FIG. 6 illustrates an explanatory drawing illustrating a state in which an appropriate amount of solder is present in the junction section between the securing portions and the conductor pattern in the coaxial connector of Embodiment 1 of the present invention.

Here, FIG. 6 illustrates a section in the coaxial connector 1 of the present embodiment mounted to the board 2 in which a securing portion 18 and conductor pattern 3 are bonded by soldering. In addition, the two-dot chain line H in FIG. 6 indicates the lowest position of the first barrier portion 21, second barrier portion 22, and third barrier portion 23. As shown in FIG. 6, the solder that bonds the securing portions 18 and the conductor pattern 3 does not expand above the two-dot chain line H. As a result, an appropriate amount of solder is present in the junction section between the securing portions 18 and the conductor pattern 3. Specifically, the space between the lower end faces of the mutually facing securing sections 18 and the surface of the conductor pattern 3 is filled with an appropriate amount of solder and, at the same time, fillets 5 of appropriate size are formed in the space between the surface of the conductor pattern 3 and the peripheral faces of the securing portions 18. When the coaxial connector 1 of the present embodiment is used, even if the board 2 is re-heated, the expansion of the solder of the junction section between the securing portions 18 and the conductor pattern 3 (solder rise) is prevented by the first barrier portion 21, second barrier portion 22, and third barrier portion 23. Therefore, even if the board 2 is re-heated, and, moreover, even if the board 2 is re-heated several times, it is possible to maintain a state, such as the one illustrated in FIG. 6, in which an appropriate amount of solder is present in the junction section between the securing portions 18 and the conductor pattern 3, and, as a result, maintain superior bond strength between the coaxial connector 1 and the board 2.

Figure 7:
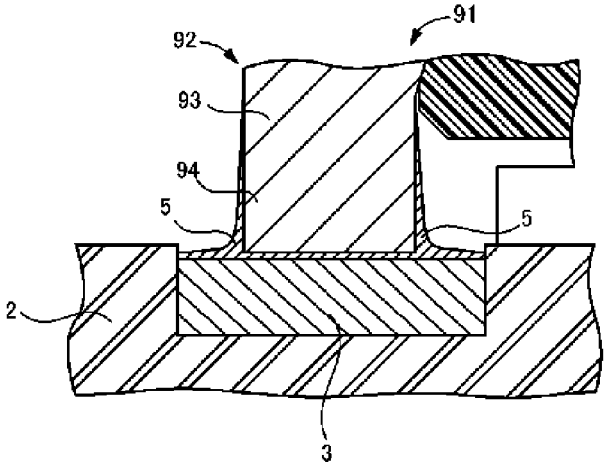
FIG. 7 illustrates an explanatory drawing illustrating the state of a coaxial connector of a comparative example in which the amount of solder present in the junction section between the securing portions and the conductor pattern has been reduced.

On the other hand, FIG. 7 illustrates a section where a securing portion 93 and a conductor pattern 3 are bonded by soldering in a coaxial connector 91, which is mounted to a board 2 according to a comparative example. In the coaxial connector 91 according to the comparative example, barrier portions blocking the flow of solder are not formed in any location on the outer conductor 92. As a result, re-heating the board 2 (or repeatedly re-heating the board 2 several times) causes the solder of the junction section between the securing portions 94 and the conductor pattern 3 to expand to the outer peripheral surface, inner peripheral surface, and lower end face of the outer conductor main body 93 and, consequently, leaves only very little solder in the junction section between the securing portions 94 and the conductor pattern 3. Specifically, the amount of solder between the lower end faces of the securing portions 94 and the surface of the conductor pattern 3 decreases, or the size of the fillets 5 becomes extremely small. In this state, a considerable decrease in the strength of the bond between the coaxial connector 91 and the board 2 takes place. If the coaxial connector 1 of the present embodiment is used, such a condition can be prevented from occurring.

In addition, the above-described solder diffusion inhibition effect due to the barrier portions in the coaxial connector 1 of the present embodiment is particularly noticeable when the coaxial connector is a surface mount-type coaxial connector. In other words, in comparison with DIP-type coaxial connectors, in which leads are inserted into through-holes in the board and soldered, the amount of solder that can adhere to the junction section in a surface mount-type coaxial connector is smaller. For this reason, when the solder of the junction section expands as a result of board re-heating, the amount of solder remaining in the junction section becomes extremely small and it becomes difficult to ensure sufficient strength of the bond between said coaxial connector and the conductor pattern on the board. If the coaxial connector 1 of the present embodiment is used, the above-mentioned barrier portions make it possible to keep an appropriate amount of solder in the junction section to thereby ensure sufficient strength of the bond between the coaxial connector and the conductor pattern on the board.

In addition, the above-described solder diffusion inhibition effect due to the barrier portions in the coaxial connector 1 of the present embodiment is particularly noticeable when the coaxial connector is a small-size connector. In other words, in the case of a small-size coaxial connector, the surface area of the junction section between the outer conductor and the conductor pattern is small, and, for this reason, the amount of solder in the junction section is reduced. Consequently, when the solder of the junction section expands as a result of board re-heating, the amount of solder in the junction section is decreased and it becomes difficult to ensure sufficient strength of the bond between the coaxial connector and the conductor pattern on the board. If the coaxial connector 1 of the present embodiment is used, the above-mentioned barrier portions make it possible to keep an appropriate amount of solder in the junction section to thereby ensure sufficient strength of the bond between the coaxial connector and the conductor pattern on the board.

Figure 8:
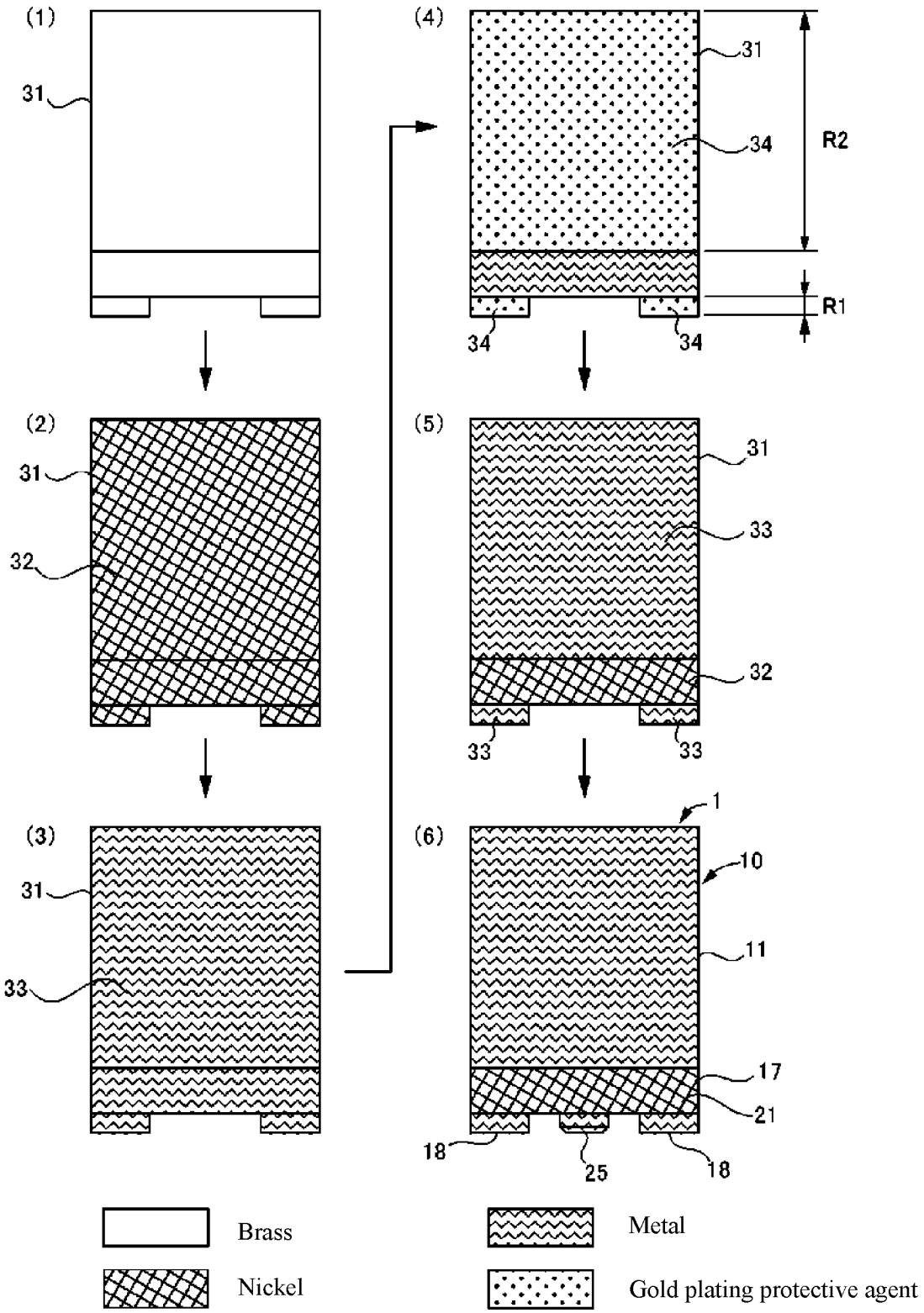
FIG. 8 illustrates an explanatory drawing illustrating the method of fabrication of the coaxial connector of Embodiment 1 of the present invention.

FIG. 8 illustrates the method of fabrication of the coaxial connector 1. The method of fabrication is as follows. First of all, as shown in FIG. 8 (1), a cylindrical metal material, such as brass or phosphor bronze, is machined to form an outer conductor component 31 shaped as the outer conductor 10 (shaping step). Next, as shown in FIG. 8 (2), the entire surface of the outer conductor component 31 (outer peripheral surface, inner peripheral surface, and each end face, etc.) is subjected to nickel plating, such that the entire surface of the outer conductor component 31 is covered with nickel 32 (strike plating step). Next, as shown in FIG. 8 (3), the entire surface of the outer conductor component 31 that has been nickel plated (outer peripheral surface, inner peripheral surface, and each end face, etc.) is subjected to gold-plating, such that the entire surface of the outer conductor component 31 is covered with another layer consisting of gold 33 (principal plating step). Next, as shown in FIG. 8 (4), a gold plating protective agent 34 is applied to sections other than the sections respectively corresponding to the first barrier portion 21, second barrier portion 22, and third barrier portion 23 of the outer conductor component 31 that have been gold-plated (protective agent application step). Next, the entire body of the outer conductor component 31, to which the gold plating protective agent 34 has been applied, is immersed in a gold plating stripping agent (stripping step). Accordingly, as shown in FIG. 8 (5), gold 33 is stripped, and nickel 32 is exposed in the sections of the outer conductor component 31 that do not have the gold plating protective agent 34 applied thereto, in other words, in the sections respectively corresponding to the first barrier portion 21, second barrier portion 22, and third barrier portion 23. This completes the fabrication of the outer conductor 10. Next, a center conductor 25, which is obtained by machining a piece of cylindrical metal material, nickel-plating it, and then covering it with another layer by gold-plating, and an insulating member 29 are prepared and, as shown in FIG. 8 (6), the center conductor 25 and the insulating member 29 are then assembled to the outer conductor 10 (assembly step). This completes the fabrication of the coaxial connector 1.

In the coaxial connector 1, the first barrier portion 21 is disposed on the outer peripheral surface of the expanded portion 17, the second barrier portion 22 is disposed on the lower end face of the outer conductor main body 11, and the third barrier portion 23 is disposed on the inner peripheral side or surface of the outer conductor main body 11, and while their respective positions and orientations are different, using the above-described method of fabrication makes it possible to easily form these barrier portions. Namely, in the protective agent application step illustrated in FIG. 8 (4), the entire range R1, which extends from a position immediately underneath the sections respectively corresponding to the first barrier portion 21, second barrier portion 22, and third barrier portion 23 of the outer conductor component 31 to the lower end of the outer conductor component 31, is immersed in the gold plating protective agent 34, after which the outer conductor component 31 is inverted and the entire range R2, which extends from a position immediately above the sections respectively corresponding to the first barrier portion 21 and the third barrier portion 23 to the upper end of the outer conductor component 31, is immersed in the gold plating protective agent 34. Accordingly, the gold plating protective agent 34 can be easily applied to sections other than the sections respectively corresponding to the first barrier portion 21, second barrier portion 22, and third barrier portion 23 of the outer conductor component 31. Subsequently, in the stripping step, immersing the outer conductor component 31 in the gold plating stripping agent makes it possible to readily strip the gold 33 applied to the sections respectively corresponding to the first barrier portion 21, second barrier portion 22, and third barrier portion 23 of the outer conductor component 31 and expose the nickel 32.

It should be noted that the coaxial connector 1 can also be fabricated using a method in which masks are formed in sections corresponding to each barrier portion in a nickel-plated outer conductor component, gold-plating is performed, and the masks are then removed.

(Embodiment 2)

Figure 9:
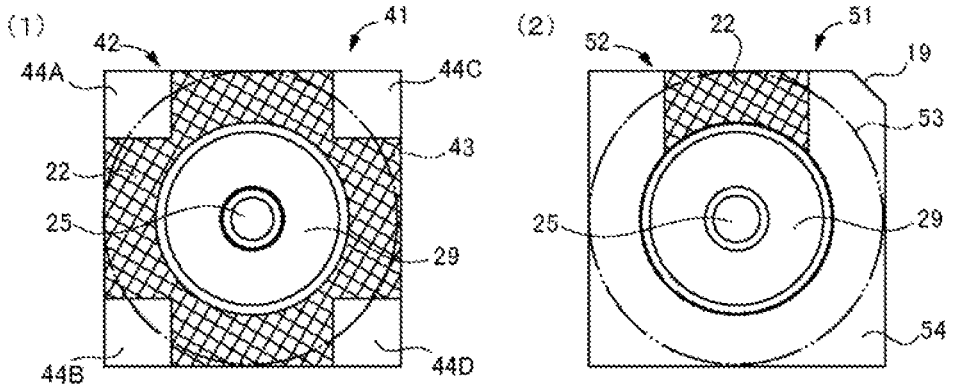
FIG. 9 illustrates an explanatory drawing illustrating the coaxial connectors of Embodiments 2 and 3 of the present invention.

FIG. 9 (1) illustrates a coaxial connector 41 according to Embodiment 2 of the present invention. In the outer conductor 42 of the coaxial connector 41, four securing portions 44A, 44B, 44C, and 44D are formed on the lower end side of the outer conductor main body 43. The securing portions 44A, 44B, 44C, and 44D project downwardly from the lower end face or from the outer peripheral surface at the bottom part of the outer conductor main body 43 (in the present embodiment, from the outer peripheral portion on the lower end face of the expanded portion 44). The four securing portions 44A, 44B, 44C, and 44D are disposed in a mutually spaced relationship at intervals in the circumferential direction of the outer conductor main body 43. While there are no limitations regarding the intervals in the circumferential direction of the securing portions 44A, 44B, 44C, and 44D, in the present embodiment, the four securing portions 44A, 44B, 44C, and 44D are disposed, for instance, at 90-degree intervals in the circumferential direction of the outer conductor main body 43. The rest of the sections of the coaxial connector 41 are similar to the coaxial connector 1 of Embodiment 1.

Disposing the four securing portions 44A, 44B, 44C, and 44D at intervals in this manner makes it possible to place other conductor patterns formed on the board 2 between the securing portions 44A and 44B and between the securing portions 44C and 44D. Alternatively, other conductor patterns can be placed between the securing portions 44A and 44C and between the securing portions 44B and 44D. As a result, even if the orientation of the coaxial connector 41 in the circumferential direction is changed by 90 degrees when the coaxial connector 41 is mounted to the board 2, the coaxial connector 41 can still be disposed so as to straddle other conductor patterns on the board 2. Therefore, mounting operations or mounting equipment can be simplified because there is no longer a need to rigidly determine the orientation of the coaxial connector 41 when mounting the coaxial connector 41 to the board 2.

(Embodiment 3)

FIG. 9 (2) illustrates a coaxial connector 51 according to Embodiment 3 of the present invention. In the outer conductor 52 of the coaxial connector 51, the securing portion 54 is formed in a C-shaped, U-shaped, or □-shaped configuration when the outer conductor 52 is viewed from below. Specifically, a securing portion 54 is formed in a continuous fashion on the lower end face of the outer conductor main body 53 with the exception of one section, for example, the one that faces forward. The rest of the sections of the coaxial connector 51 are similar to the coaxial connector 1 of Embodiment 1.

In accordance with the present embodiment, the surface area of the lower end face of the securing portion 54 is increased, and, as a result, the amount of solder interposed between the lower end face of the securing portion 54 and the surface of the conductor pattern 3 on the board 2 can be increased. In addition, the area of contact between the securing portion 54 and the solder fillets can be increased because the surface area of the peripheral face of the securing portion 54 is also increased. Therefore, the strength of the bond between the coaxial connector 51 and the board 2 can be increased.

(Embodiment 4)

Figure 10:
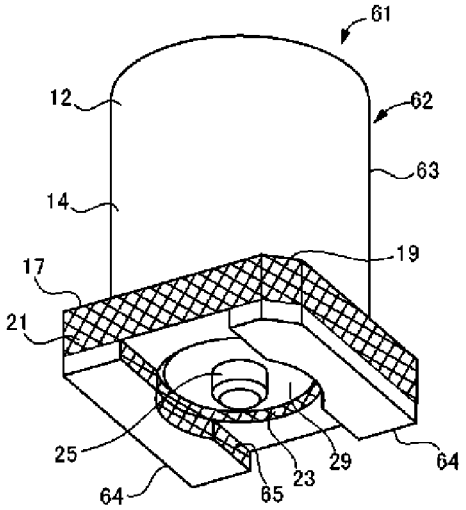
FIG. 10 illustrates an explanatory drawing illustrating the coaxial connector of Embodiment 4 of the present invention.

FIG. 10 illustrates a coaxial connector 61 according to Embodiment 4 of the present invention. In the outer conductor 62 of the coaxial connector 61, a fourth barrier portion 65 blocking the flow of solder is formed on the inner peripheral surface of the securing portions 64. It should be noted that no barrier portions are formed on the lower end face of the outer conductor main body 63 of the coaxial connector 61. In accordance with the present embodiment, the fourth barrier portion 65 can be used to prevent the solder that bonds the securing portions 64 and the conductor pattern 3 from expanding across the inner peripheral surface of the securing portions 64 to the lower end face etc. of the outer conductor main body 62 where no barrier portions are formed. Therefore, a decrease in the strength of the bond between the coaxial connector 61 and the board 2 can be prevented. In addition, in accordance with the present embodiment, solder can be prevented from adhering to the inner peripheral surface of the securing portions 64 and to the inner peripheral surface of the outer conductor main body 62. This makes it possible to prevent irregularities in the distance between the center conductor 25 and the surface of the surrounding conductor as a result of solder adhesion. Therefore, when the coaxial connector 1 is used, for example, as a coaxial connector for high-frequency signals, its impedance and other electrical performance characteristics can be adequately implemented according to design requirements.

(Embodiment 5)

Figure 11:
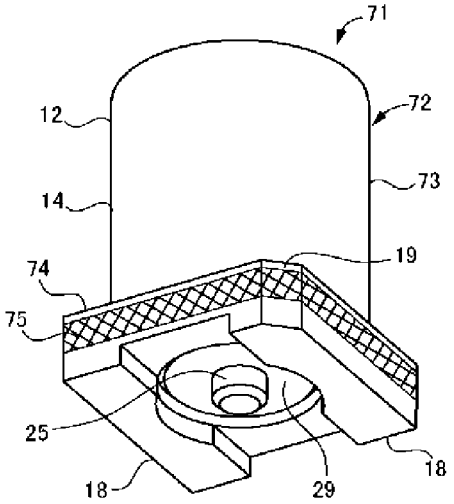
FIG. 11 illustrates an explanatory drawing illustrating the coaxial connector of Embodiment 5 of the present invention.

FIG. 11 illustrates a coaxial connector 71 according to Embodiment 5 of the present invention. In the outer conductor 72 of the coaxial connector 71, a first barrier portion 75 is formed on the outer peripheral surface at the bottom part (expanded portion 74) of the outer conductor main body 73 at a position located upwardly away from the lower side edge. It should be noted that no barrier portions are formed on the lower end face and inner peripheral surface of the outer conductor main body 73 of the coaxial connector 71. The rest of the sections of the coaxial connector 71 are similar to the coaxial connector 1 of Embodiment 1. In accordance with the present embodiment, disposing the first barrier portion 75 in such a position makes it possible to readily manufacture the first barrier portion 75 using a method in which the barrier portion is formed with the help of a mask It should be noted that the shape of the outer conductor main body 11 in the above-described in Embodiment 1 is not limited to cylinders and may include polygonal tubes. In addition, the metal used for plating on the outer conductor 10 or on the top surface of the center conductor 25 is not limited to gold and may be, for example, tin. In addition, the metal exposed in the barrier portions 21, 22, and 23 of the outer conductor 10 may be a metal other than nickel, which has low solder wettability. In addition, the barrier portions 21, 22, and 23 may be formed by decreasing solder wettability on the outer peripheral surface at the bottom part, etc. of the outer conductor main body 11 through alloying or oxidizing with the help of laser irradiation, or by applying resin instead of metal to the outer peripheral surface at the bottom part, etc. of the outer conductor main body 11. Furthermore, the external configuration of the expanded portion 17 is not limited to a square and may be of a circular flange-like shape. Moreover, it is not necessary to have the expanded portion 17. In addition, although the contact portion 26 of the center conductor 25 is female-type, it may be male-type. In addition, while the above-described Embodiment 1 used an example in which the lower end portion of the rectilinear center conductor 25 was connected to the conductor pattern 4 formed on the surface of the board 2, the shape of the center conductor and the type of connection between the conductor pattern formed on the board and the center conductor are not limited thereto. For example, a configuration may be used in which the lower end side of the center conductor is bent 90 degrees and extends laterally of the outer conductor 10 between the two securing portions 18. In another possible configuration, the lower end portion of the center conductor extends inside a multilayer board and is connected to conductor patterns inside the multilayer board. The above-described modifications of Embodiment 1 can also be applied to other embodiments described above.

Furthermore, the present invention can be appropriately modified as long as the modifications do not contradict the gist or concept of the invention that can be read from its claims and specification taken in its entirety, and coaxial connectors based on those types of modifications are within the inventive concept of the present invention.

DESCRIPTION OF THE REFERENCE NUMERALS 1, 41, 51, 61, 71 Coaxial connectors

2 Board

3, 4 Conductor patterns
5 Fillet
10, 42, 52, 62, 72 Outer conductors
11, 43, 53, 63, 73 Outer conductor main bodies
12 Mating portion
14 Supporting portion
17, 74 Expanded portions
18, 44A, 44B, 44C, 44D, 54, 64 Securing portions
21, 75 First barrier portion
22 Second barrier portion
23 Third barrier portion
25 Center conductor
29 Insulating member
65 Fourth barrier portion

What is claimed is:

1. A coaxial connector comprising an outer conductor and a center conductor provided inside the outer conductor,
wherein the outer conductor comprises:
a tubular outer conductor main body;
a mating portion, which is formed on one side in the axial direction of the outer conductor main body and detachably mates with a counterpart connector;
a supporting portion, which is formed on the other side in the axial direction of the outer conductor main body and supports the center conductor through the medium of an insulating member;
securing portions, which project from the end face on the other side in the axial direction or from the outer peripheral surface on the other side in the axial direction of the outer conductor main body towards the other side in the axial direction and secure the outer conductor by soldering to a conductor pattern formed on the surface of the board; and
a first barrier portion, which is formed on the outer peripheral surface on the other side in the axial direction of the outer conductor main body, or on a section located away from the edge on the other side in the axial direction of the securing portions toward one side in the axial direction on the outer peripheral surface of the securing portions, and which blocks the flow of solder;
wherein an expanded portion expanded in the radial direction to a greater extent than the outer peripheral surface on the other side in the axial direction of said outer conductor main body is formed on the other side in the axial direction of the outer conductor main body, and the first barrier portion is formed on the outer peripheral surface of the expanded portion;
wherein solder wettability of the first barrier portion is lower than that of the outer peripheral surface of the securing portions.

2. The coaxial connector according to claim 1, wherein a second barrier portion that blocks the flow of solder is formed on the end face on the other side in the axial direction of the outer conductor main body.

3. The coaxial connector according to claims 1, wherein a third barrier portion that blocks the flow of solder is formed on the inner peripheral surface on the other side in the axial direction of the outer conductor main body.

4. The coaxial connector according to claim 1, wherein a fourth barrier portion that blocks the flow of solder is formed on the inner peripheral surface of the securing portions.

5. The coaxial connector according to claim 1, wherein the first barrier portion is formed on a section located away from the edge on the other side in the axial direction toward one side in the axial direction on the outer peripheral surface on the other side in the axial direction of the outer conductor main body.

6. The coaxial connector according to claim 1, wherein two securing portions are formed on the end face on the other side in the axial direction or on the outer peripheral surface on the other side in the axial direction of the outer conductor main body, and the two securing portions are disposed in a mutually spaced relationship in the radial direction of the outer conductor main body.

7. The coaxial connector according to any of claim 1, wherein four securing portions are formed at intervals in the circumferential direction on the end face on the other side in the axial direction or on the outer peripheral surface on the other side in the axial direction of the outer conductor main body.

8. The coaxial connector according to claim 1, wherein the securing portions are formed in a C-shaped, U-shaped, or Π-shaped configuration when the outer conductor is viewed from the other side in the axial direction thereof.

9. A coaxial connector comprising an outer conductor and a center conductor provided inside the outer conductor,
wherein the outer conductor comprises:
a tubular outer conductor main body;
a mating portion, which is formed on one side in the axial direction of the outer conductor main body and detachably mates with a counterpart connector;
a supporting portion, which is formed on the other side in the axial direction of the outer conductor main body and supports the center conductor through the medium of an insulating member;
securing portions, which project from the end face on the other side in the axial direction or from the outer peripheral surface on the other side in the axial direction of the outer conductor main body towards the other side in the axial direction and secure the outer conductor by soldering to a conductor pattern formed on the surface of the board; and
a first barrier portion, which is formed on the outer peripheral surface on the other side in the axial direction of the outer conductor main body, or on a section located away from the edge on the other side in the axial direction of the securing portions toward one side in the axial direction on the outer peripheral surface of the securing portions, and which blocks the flow of solder;
wherein a second barrier portion that blocks the flow of solder is formed on the end face on the other side in the axial direction of the outer conductor main body;
wherein solder wettability of the first barrier portion is lower than that of the outer peripheral surface of the securing portions.

10. The coaxial connector according to claim 9, wherein a third barrier portion that blocks the flow of solder is formed on the inner peripheral surface on the other side in the axial direction of the outer conductor main body.

11. The coaxial connector according to claim 9, wherein a fourth barrier portion that blocks the flow of solder is formed on the inner peripheral surface of the securing portions.

12. The coaxial connector according to claim 9, wherein the first barrier portion is formed on a section located away from the edge on the other side in the axial direction toward one side in the axial direction on the outer peripheral surface on the other side in the axial direction of the outer conductor main body.

13. The coaxial connector according to claim 9, wherein two securing portions are formed on the end face on the other side in the axial direction or on the outer peripheral surface on the other side in the axial direction of the outer conductor main body, and the two securing portions are disposed in a mutually spaced relationship in the radial direction of the outer conductor main body.

14. The coaxial connector according to any of claim 9, wherein four securing portions are formed at intervals in the circumferential direction on the end face on the other side in the axial direction or on the outer peripheral surface on the other side in the axial direction of the outer conductor main body.

15. The coaxial connector according to claim 9, wherein the securing portions are formed in a C-shaped, U-shaped, or Π-shaped configuration when the outer conductor is viewed from the other side in the axial direction thereof.

* * * * *